US009599397B2

(12) United States Patent
Jackson

(10) Patent No.: US 9,599,397 B2
(45) Date of Patent: Mar. 21, 2017

(54) LIGHT CURING APPARATUS HAVING A MODULAR LAMP HOUSING

(75) Inventor: Douglas K. Jackson, Round Rock, TX (US)

(73) Assignee: NCC NANO, LLC, Dallas, TX (US)

( * ) Notice: Subject to any disclaimer, the term of this patent is extended or adjusted under 35 U.S.C. 154(b) by 1338 days.

(21) Appl. No.: 12/871,258

(22) Filed: Aug. 30, 2010

(65) Prior Publication Data

US 2012/0051046 A1 Mar. 1, 2012

(51) Int. Cl.

| | |
|---|---|
| ***B05D 3/06*** | (2006.01) |
| ***F26B 13/10*** | (2006.01) |
| *B05D 3/00* | (2006.01) |
| *F26B 3/28* | (2006.01) |

(52) U.S. Cl.

CPC ..... *F26B 13/10* (2013.01); *B05D 3/061* (2013.01); *B05D 3/067* (2013.01); *F26B 3/28* (2013.01)

(58) Field of Classification Search

CPC ..... F26B 13/10; B05D 3/061; B05D 3/067

USPC ..... 362/217.01–217.17, 232–248, 285, 362/287–289, 319, 362–372, 429; 250/504 R, 493.1, 492.1, 455.11, 453.11

See application file for complete search history.

(56) References Cited

U.S. PATENT DOCUMENTS

| | | | | |
|---|---|---|---|---|
| 4,051,362 | A * | 9/1977 | Guggemos | F21V 21/02 362/432 |
| 5,060,125 | A * | 10/1991 | Cowie | B41F 23/0409 362/217.07 |
| 6,280,801 | B1 * | 8/2001 | Schmitt | B41M 7/0081 118/620 |
| 6,530,674 | B2 * | 3/2003 | Grierson | F21V 21/005 362/219 |
| 6,566,660 | B1 * | 5/2003 | Stowe | B05D 3/067 250/455.11 |
| 2004/0011969 | A1 * | 1/2004 | Cekic | B05D 3/067 250/504 R |
| 2008/0134589 | A1 * | 6/2008 | Abrams | E04B 1/003 52/79.1 |
| 2009/0181184 | A1 * | 7/2009 | Pope | B41M 3/001 427/554 |

* cited by examiner

*Primary Examiner* — Anh Mai
*Assistant Examiner* — Nathaniel Lee
(74) *Attorney, Agent, or Firm* — Russell Ng PLLC; Antony P. Ng

(57) ABSTRACT

A curing apparatus is disclosed. The curing apparatus includes a flash lamp and a lamp housing for containing the flash lamp with the flash lamp's longitudinal axis in parallel with the direction of motion of a moving substrate irradiated by the flash lamp. The lamp housing is capable of attaching to a second lamp housing to form a concatenated lamp housing having a common reflector cavity. The second lamp housing also holds a second flash lamp with the second flash lamp's longitudinal axis in parallel with the direction of the moving substrate under the second flash lamp.

11 Claims, 3 Drawing Sheets

LIGHT CURING APPARATUS HAVING A MODULAR LAMP HOUSING

BACKGROUND OF THE INVENTION

1. Technical Field

The present invention relates to light curing apparatuses in general, and, in particular, to a light curing apparatus having a modular lamp housing.

2. Description of Related Art

A thin film on a low-temperature substrate can be cured by exposing the thin film to a brief but high-intensity light pulse. The thin film becomes heated after absorbing the light. This process is often preferred over conventional oven curing when the desired processing temperature is higher than the working temperature of the substrate. The transient heating heats the thin film without heating the substrate, and thus allows the rapid removal of solvents that may be in the thin film, even if their boiling point is significantly higher than the maximum working temperature of the substrate.

The present disclosure provides a light curing system capable of handling high-temperature curing of thin films on low-temperature substrates of various widths.

SUMMARY OF THE INVENTION

In accordance with a preferred embodiment of the present invention, a light curing apparatus includes a flash lamp and a lamp housing for containing the flash lamp with the flash lamp's longitudinal axis in parallel with the direction of motion of a moving substrate irradiated by the flash lamp. The lamp housing is configured to attach to a second lamp housing to form a concatenated lamp housing having a common reflector cavity. The second lamp housing also holds a second flash lamp with the second flash lamp's longitudinal axis in parallel with the direction of the moving substrate under the second flash lamp.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

For the present invention, curing is defined as processing a thin film on a substrate using light, including drying, particle sintering, film densification, chemical reaction initiation, phase transformation, grain growth, annealing, heat treating, etc. The substrate may additionally be a low-temperature substrate. A thin film is defined as a coating of less than 100 microns thick. Examples of low-temperature substrates include paper, plastic or polymer.

Figure 1:
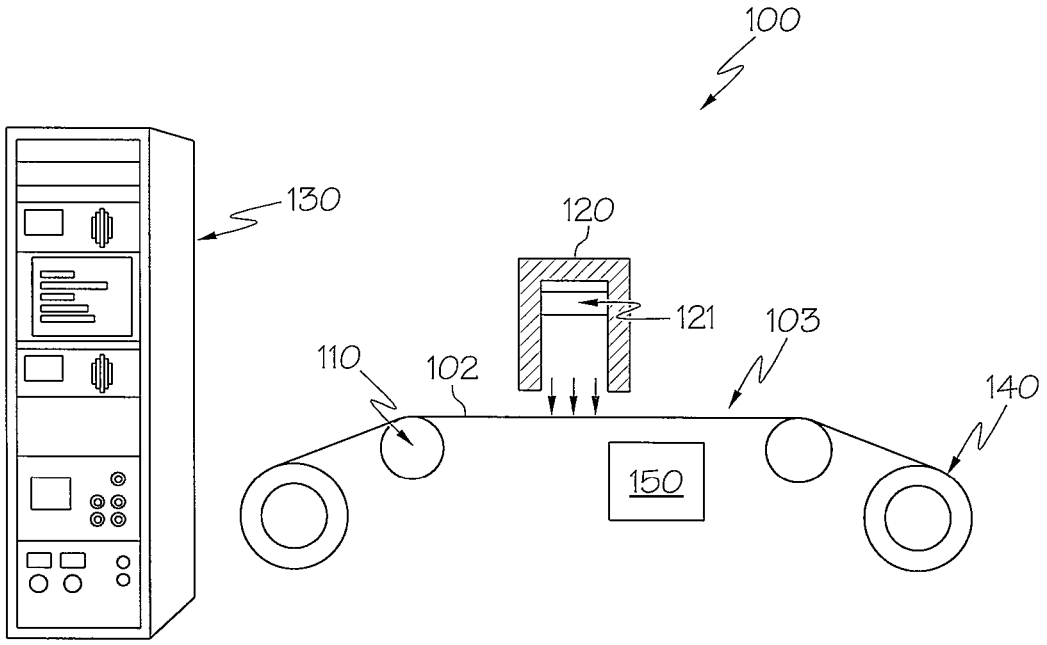
FIG. 1 is a diagram of a curing apparatus, in accordance with a preferred embodiment of the present invention.

Referring now to the drawings and in particular to FIG. 1, there is depicted a diagram of a curing apparatus for curing thin films on a flexible substrate, in accordance with a preferred embodiment of the present invention. As shown, a curing apparatus 100 includes a conveyor system 110, a lamp housing 120, a relay rack 130 and a reel-to-reel feeding system 140. Curing apparatus 100 is capable of curing a thin film 102 mounted on a flexible substrate 103 situated on a web being conveyed past lamp housing 120 at a relatively high speed. Thin film 102 can be added on substrate 103 by one or combinations of existing technologies such as screen-printing, inkjet printing, gravure, laser printing, xerography, pad printing, painting, dip-pen, syringe, airbrush, flexographic, CVD, PECVD, evaporation, sputtering, etc. The deposition of thin film 102 onto substrate 103 may be performed inline with the curing process. Lamp housing 120, which is preferably water cooled, includes a xenon flash lamp 121 for curing thin film 102 located on substrate 103.

Relay rack 130 includes an adjustable power supply, a conveyance control module, and a strobe control module. The adjustable power supply can produce pulses with an energy of up to 4 kilojoules per pulse per lamp. The adjustable power supply is connected to xenon flash lamp 121, and the intensity of the emission from xenon flash lamp 121 can be varied by controlling the amount of current passing through xenon flash lamp 121. The power, pulse duration and pulse repetition frequency of the pulsed emissions from xenon flash lamp 121 are electronically adjusted and synchronized to the web speed to allow optimum curing of thin film 102 without damaging substrate 103, depending on the optical, thermal and geometric properties of thin film 102 and substrate 103.

Curing apparatus 100 can preferably accommodate a web of any width in 3-inch increments. Conveyor system 110 can move substrate 103 at speeds from 2 to 1000 feet/min.

During the curing operation, conveyor system 110 moves thin film 102 under lamp housing 120 where thin film 102 is cured by rapid pulses emitted from xenon flash lamp 121. The power, duration and repetition rate of the emissions from xenon flash lamp 121 are controlled by the strobe control module within relay rack 130, and the speed at which substrate 203 is being moved past lamp housing 120 is determined by the conveyor control module within relay rack 130.

A sensor 150, which can be mechanical, electrical, or optical, is utilized to sense the speed of conveyor system 110. For example, the conveyor belt speed of conveyor belt system 110 can be sensed by detecting a signal from a shaft encoder connected to a wheel that makes contact with the moving conveyor belt. In turn, the pulse repetition rate can be synchronized with the conveyor belt speed of conveyor belt system 110. The synchronization of the strobe pulse rate f is given by:

$$f = \frac{0.2 \times s \times o}{w}$$

where s=web speed [ft/min]

o=overlap factor w=exposure width in the direction of web motion [in]

Overlap factor is the average number of strobe pulses that are received by a substrate at any one location. For example, with a web speed of 200 ft/min, an overlap factor of 5, and a curing head width of 2.75 inches, the pulse rate of the strobe is 72.7 Hz.

Xenon flash lamp 121 can provide pulses of different intensity, pulse length, and pulse repetition frequency. For example, xenon flash lamp 121 can provide 10 μs to 10 ms pulses with a 3" by 6" wide footprint at a pulse repetition rate of up to 1 kHz. The spectral content of the emissions from xenon flash lamp 121 ranges from 200 nm to 2,500 nm. The spectrum can be adjusted by replacing the quartz lamp with a cerium doped quartz lamp to remove most of the emission below 350 nm. The quartz lamp can also be replaced with a sapphire lamp to extend the emission from approximately 140 nm to approximately 4,500 nm. Filters may also be added to remove other portions of the spectrum. Xenon flash lamp 121 can also be a water wall flash lamp that is sometimes referred to as a Directed Plasma Arc (DPA) lamp.

When xenon flash lamp 121 is pulsed, thin film 102 is momentarily heated. When a rapid pulse train is combined with moving substrate 103, a uniform cure can be attained over an arbitrarily large area in the web direction as each section of thin film 102 may be exposed to multiple pulses, which approximates a continuous curing system such as an oven.

Figure 2:
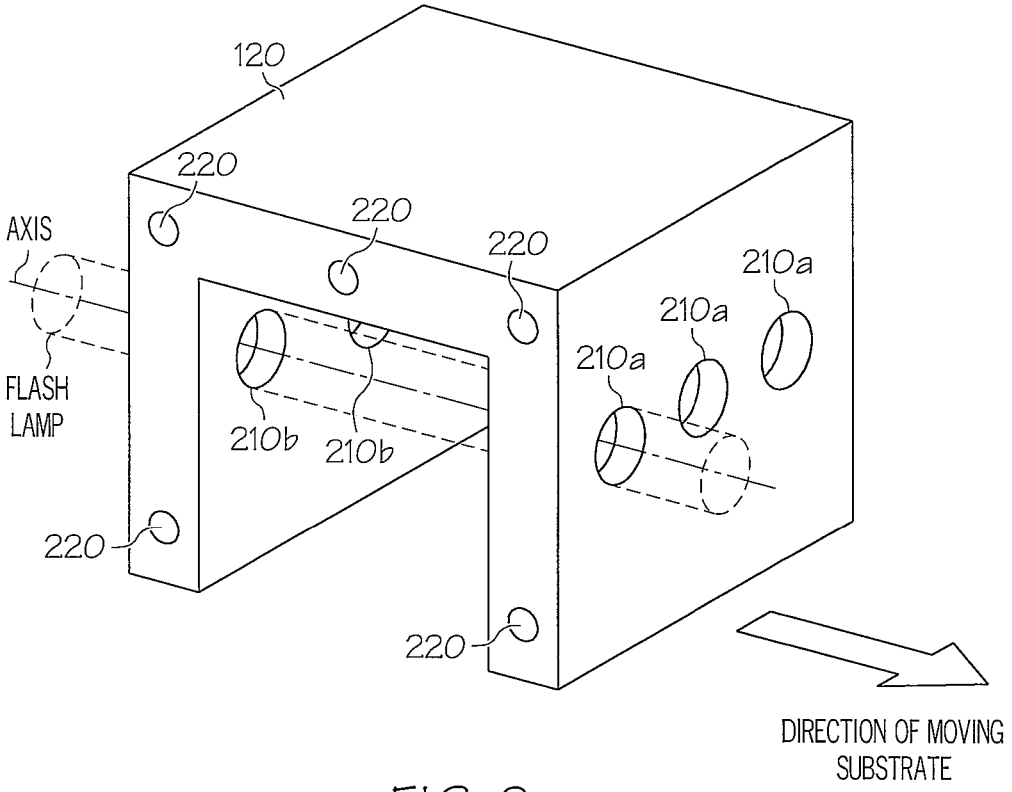
FIG. 2 is an isometric view of a lamp housing within a curing apparatus from FIG. 1, in accordance with a preferred embodiment of the present invention.

With reference now to FIG. 2, there is depicted an isometric view of lamp housing 120, in accordance with a preferred embodiment of the present invention. As shown, lamp housing 120 includes multiple lamp holes 210*a* and 210*b* for receiving flash lamps (not shown), such as xenon flash lamp 121 from FIG. 1. Lamp housing 120 also includes multiple internal channels 220 for transporting fluid intended for the purpose of cooling lamp housing 120. Such fluid can be, for example, water.

Lamp housing 120 is attached to conveyor system 100 from FIG. 1 such that the longitudinal axes of flash lamps within holes 210*a* and 210*b* are in parallel to the direction of substrate 103 being moved by conveyor system 100. Lamp housing 120 is preferably made of aluminum, and the inside surface is polished to increase its reflectivity.

Lamp housing 120 is designed to be modular in nature. In other words, lamp housing 120 is capable of attaching to an other lamp housing, and the other lamp housing holds another set of flash lamps with their longitudinal axis in parallel with the direction of a moving substrate.

Figure 3A:
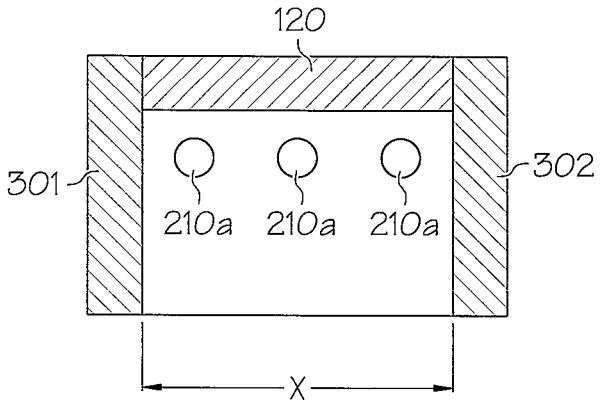
FIGS. 3*a*-3*b* are two side views of two lamp housings, in accordance with a preferred embodiment of the present invention.
Figure 3B:
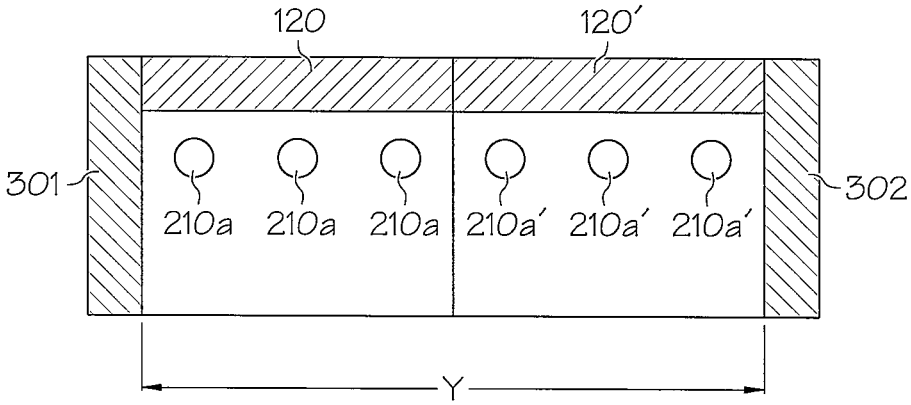

Referring now to FIGS. 3*a*-3*b*, there are depicted two side views of two lamp housings, in accordance with a preferred embodiment of the present invention. In FIG. 3*a*, lamp housing 100 is being shown as a single module having endcaps 301 and 302. The maximum width of a substrate that can be simultaneously cured by flash lamps within lamp housing 120 is x when all lamp holes 210*a* are fully populated with flash lamps.

In FIG. 3*b*, lamp housing 120 is concatenated with a second lamp housing 120' as a single module having endcaps 301 and 302. The maximum width of a substrate that can be simultaneously cured by flash lamps within lamp housings 120 and 120' is y when all holes 210*a* and 210*a'* are fully populated with flash lamps. The width of lamp housing 120' can be different from that of lamp housing 120. Lamp housing 120 is aligned with lamp housing 120' via guide pins. Lamp housing 120 and lamp housing 120' are held together with multiple common tension rods. Water cooling for curing apparatus 100 runs through internal channels 220 within lamp housings 120 and 120' in series.

The concatenation of lamp housings 120 and 120' enables the curing thin films on an arbitrarily wide substrate within a common reflector housing multiple identical drive electronic units, which allows for easier retrofitting to existing print lines. Another benefit is that the radiated beam pattern is very uniform perpendicular to the web conveyance. This results in exceptionally uniform curing of a thin film as it is being conveyed past lamp housings 120 and 120'. This is due in part to the averaging effect of multiple flash lamps sharing a single reflector. The averaging over multiple flash lamps also reduces the lamp-to-lamp uniformity requirement throughout the lifetime of flash lamps.

The modular design of lamp housing, such as lamp housing 120, also allows for the duplication of the drive electronics. Since flash lamps are merely duplicated with the addition of lamp housing, the drive electronics do not have to be redesigned for different web widths.

The modular design of lamp housing also allows the duplication of process parameters for curing a thin film as it is being conveyed. Since the identical drive electronics and identical lamps are used, the setting for the process parameters are identical and no additional curing process development, which is time consuming and costly, is needed for upgrading to a wider format.

As has been described, the present invention provides a light curing apparatus having a modular lamp housing.

While the invention has been particularly shown and described with reference to a preferred embodiment, it will be understood by those skilled in the art that various changes in form and detail may be made therein without departing from the spirit and scope of the invention.

What is claimed is:

1. A curing apparatus comprising:

a conveyor system for moving a substrate;

a strobe head configured to include plurality of lamp housings for accommodating said substrate of any width in a predetermined width increment, wherein a first one of said lamp housings contains a first flash lamp having a longitudinal axis in parallel with the direction of motion of said moving substrate to be irradiated by said first flash lamp, wherein a second one of said lamp housings is removably attached to said first lamp housing, wherein said second lamp housing is aligned with said first lamp housing via guide pins, wherein said second lamp housing contains a second flash lamp having a longitudinal axis in parallel with said direction of motion of said moving substrate to be irradiated by said second flash lamp; and a strobe control module for controlling power, duration and repetition rate of a plurality of pulses to be discharged by said first and second flash lamps.

2. The curing apparatus of claim 1, wherein the width of said first lamp housing is different from the width of said second lamp housing.

3. The curing apparatus of claim 1, wherein said curing apparatus further includes a conveyor control module, in conjunction with said strobe control module, for synchronizing in real-time said repetition rate of said plurality of pulses with the speed at which said substrate is being moved under said flash lamps.

4. The curing apparatus of claim 1, wherein said flash lamps are xenon flash lamps.

5. The curing apparatus of claim 1, wherein said flash lamps are Directed Plasma Arc lamps.

6. The curing apparatus of claim 1, wherein said curing apparatus further includes internal channels for transporting fluid to cool said curing apparatus.

7. A curing apparatus comprising:

a conveyor system for moving a substrate;

a strobe head configured to include a plurality of lamp housings for accommodating said substrate of any width in a predetermined width increment, wherein a first one of said lamp housings contains a first flash lamp having a longitudinal axis in parallel with the direction of motion of said moving substrate to be irradiated by said first flash lamp, wherein a second one of said lamp housings is removably attached to said first lamp housing, wherein said first and second lamp housings are held together with a plurality of tension rods, wherein said second lamp housing contains a second flash lamp having a longitudinal axis in parallel with said direction of motion of said moving substrate to be irradiated by said second flash lamp; and a strobe control module for controlling power, duration and repetition rate of a plurality of pulses to be discharged by said first and second flash lamps.

8. The curing apparatus of claim 7, wherein said curing apparatus further includes a conveyor control module, in conjunction with said strobe control module, for synchronizing in real-time said repetition rate of said plurality of pulses with the speed at which said substrate is being moved under said flash lamps.

9. The curing apparatus of claim 7, wherein said flash lamps are xenon flash lamps.

10. The curing apparatus of claim 7, wherein said flash lamps are Directed Plasma Arc lamps.

11. The curing apparatus of claim 7, wherein said curing apparatus further includes internal channels for transporting fluid to cool said curing apparatus.

* * * * *